US005451366A

United States Patent [19]

Kumagai et al.

[11] Patent Number: 5,451,366

[45] Date of Patent: Sep. 19, 1995

[54] PRODUCT OF A HALOGEN CONTAINING TI-A1 SYSTEM INTERMETALLIC COMPOUND HAVING A SUPERIOR OXIDATION AND WEAR RESISTANCE

[75] Inventors: Masaki Kumagai; Kazuhisa Shibue; Mok-soon Kim; Tsutomu Furuyama, all of Nagoya, Japan

[73] Assignee: Sumitomo Light Metal Industries, Ltd., Japan

[21] Appl. No.: 91,601

[22] Filed: Jul. 13, 1993

[30] Foreign Application Priority Data

| | | | |
|---|---|---|---|
| Jul. 17, 1992 | [JP] | Japan | 4-191093 |
| May 11, 1993 | [JP] | Japan | 5-109576 |
| May 11, 1993 | [JP] | Japan | 5-109577 |

[51] Int. Cl.[6] ..... C22C 14/00

[52] U.S. Cl. ..... 420/418; 148/269; 148/421; 420/421

[58] Field of Search ..... 148/269, 421; 420/418, 420/421

[56] References Cited

U.S. PATENT DOCUMENTS

| | | | |
|---|---|---|---|
| 4,437,888 | 3/1984 | Jecker | 75/84.4 |
| 5,120,497 | 6/1992 | Sayashi et al. | 420/418 |

FOREIGN PATENT DOCUMENTS

| | | | |
|---|---|---|---|
| 0146115 | 6/1985 | European Pat. Off. . | |
| 0413524 | 2/1991 | European Pat. Off. . | |
| 3828612 | 3/1989 | Germany . | |
| 0111152 | 5/1963 | Japan | C22C 14/00 |
| 130898 | 6/1989 | Japan . | |
| 1287243 | 11/1989 | Japan | C22C 14/00 |
| 4160128 | 6/1992 | Japan | C22C 14/00 |
| 2211211 | 6/1989 | United Kingdom . | |

OTHER PUBLICATIONS

Research Report of the 123rd Committee on Heat-resistant Material Journal of Japan Society for the Promotion of Science vol. 29 No. 1 (1988) pp. 77–87 authored by Tsurumi et al.

Minute of Autumn Conference of the Japan Institute of Metals Journal vol. 54 No. 8 (Aug. 1990) pp. 948–954 authored by Kasahara et al.

Minute of Autumn Conference of the Japan Institute of Metals Journal vol. 29 (Sep. 1990) p. 274 authored by Anada et al.

Minute of Autumn Conference of the Japan Institute of Metals Journal (1991) vol. 30 p. 561 authored by Anada et al.

*Primary Examiner*—Upendra Roy

*Attorney, Agent, or Firm*—Davis, Bujold & Streck

[57] ABSTRACT

A Ti—Al system intermetallic compound comprised of 25 at. % to 75 at. % of aluminum and the remainder of titanium. The compound includes 0.004 at. % to 1.0 at. % each of at least one halogen element selected from the group consisting of fluorine, chlorine, bromine and iodine. Alternatively, to provide a Ti—Al system intermetallic compound with oxidation resistance, the surface of the Ti—Al system intermetallic compound is heated to 800° C. to 1125° C. in a mixture of gas including 2 ppm to 1% by volume of at least one halogen element selected from the group consisting of fluorine, chlorine, bromine and iodine, and also including 0.1% by volume or more of oxygen. Thus, a dense aluminum oxide film is formed on the surface of the intermetallic compound. Alternatively, to form the dense aluminum oxide film, at least one halogen element is first disposed on the part providing the oxidation resistance of the intermetallic compound, and heated for 0.2 hour or longer at 800° C. to 1125° C. In this case, the halogen amount should be between 0.002 mol/m$^2$ and 2 mol/m$^2$.

7 Claims, No Drawings

PRODUCT OF A HALOGEN CONTAINING TI-A1 SYSTEM INTERMETALLIC COMPOUND HAVING A SUPERIOR OXIDATION AND WEAR RESISTANCE

FIELD OF THE INVENTION

This invention relates to a product of a Ti—Al system intermetallic compound which is used in the field of automobile, aerospace, industrial machine tools and others, and further relates to a method of producing a product of the Ti—Al system intermetallic compound, which requires lightweight, high-temperature strength, high rigidity, oxidation resistance and wear resistance.

BACKGROUND OF THE INVENTION

Recently, in the field of automobiles, lightweight and high performance were demanded simultaneously. Especially, the engine components are required to be light in weight.

For example, steel or nickel alloys are used as engine valves. However, these materials are so dense that the inertial mass of the engine valves is large, which hinders an engine from rotating at high speed. By making the engine valves lightweight, the inertial mass of the valves can be reduced. Thus, the engine can be rotated at high speed and an automobile with high performance can be provided. To meet such needs, a Ti—Al system intermetallic compound is highly demanded as a lightweight, heat-resistant material, because this compound has low density and superior strength at high temperature. For such reasons, the compound has been widely researched and developed.

However, the practical use of the Ti—Al intermetallic compound is hindered for the following three reasons:

(1) the compound has an insufficient ductility at room temperature;

(2) the compound is hard to work, thereby difficult to shape into components; and (3) the component has an insufficient oxidation resistance.

To solve these problems, the Ti—Al system intermetallic compound has been widely and variously researched and developed.

It is now clarified that the addition of manganese, chromium, vanadium or the like can improve the ductility at room temperature of the intermetallic compound.

Japan Laid-open Patent Application No. 1-30898 proposes an improvement in the difficulty in working the Ti—Al system intermetallic compound. The proposed Ti—Al system intermetallic compound is prepared by a reaction sintering process. Specifically, titanium or titanium alloy powder is first mixed with aluminum or aluminum alloy powder, and is then degassed and charged through a vacuum. Subsequently, the mixed powder is plastically deformed at the reacting synthesis temperature or lower temperature. Thus obtained mixed body is heated to the reacting synthesis temperature or a higher temperature.

The improvement in the oxidation resistance of the Ti—Al system intermetallic compound is researched and developed, as seen in the following documents:

(1) Research Report of the 123rd Committee on Heat-resistance Material, Japan Society for the Promotion of Science Vol.29 No.1 (1988), P77–87, in which Tsurumi et al. proves the improvement by the addition of niobium;

(2) Minute of Autumn Conference of the Japan Institute of Metals; Journal Vol.29 (1990), P274, in which Anada et al. proves the improvement by the addition of molybdenum;

(3) Minute of Autumn Conference of the Japan Institute of Metals; Journal Vol.30 (1991), P561, in which Anada et al. proves the improvement by the addition of tungsten; and (4) Minute of Autumn Conference of the Japan Institute of Metals; Journal Vol.54 No.8 (1990), P948–P954, in which Kasahara et al. proves the improvement by the addition of silicon.

However, such improvements in oxidation resistance are insufficient for the practical use of the Ti—Al system intermetallic compound.

The components disposed around an engine are mostly sliding members. If such components are made of titanium aluminide, they are easily worn, which is a problem in practical use. Lightweight and at the same time wear resistant sliding members are expected.

SUMMARY OF THE INVENTION

Wherefore, an object of this invention is to provide a product of a Ti—Al system intermetallic compound having a superior oxidation resistance.

Another object of the invention is to provide a method of manufacturing a product of a Ti—Al system intermetallic compound, such that the resulting intermetallic compound has a superior oxidation resistance.

Further object of the present invention is to provide a product of lightweight, wear-resistant Ti—Al system intermetallic compound and a method of manufacturing the product.

To attain this or other objects, this invention provides a product of a Ti—Al system intermetallic compound substantially comprising titanium and aluminum. The product is provided with a surface layer including 0.004 at. % to 1.0 at. % of at least one halogen element selected from the group consisting of fluorine, chlorine, bromine and iodine. Not only the surface of the product, but the entire product itself can include 0.004 at. % to 1.0 at. % of at least one halogen element selected from the group consisting of fluorine, chlorine, bromine and iodine. The symbol at. % is the ratio of the atoms of the compound composed of a given element. It is found by dividing the percent by weight of each element in the compound by that elements atomic weight and taking the ratio of the result as at. %. If the amount of the halogen element is less than the lower limit, the oxidation resistance of the compound is insufficient, and if the amount exceeds the upper limit, the elongation of ductility of the compound is lowered.

The Ti—Al system intermetallic compound preferably comprises 25 at. % to 75 at. % of aluminum and the remainder at. % of titanium. If the amount of aluminum is less than the lower limit, the ductility of the compound is decreased, and if the amount exceeds the upper limit, the strength of the compound is decreased.

The Ti—Al system intermetallic compound preferably includes 0.5 at. % to 3 at. % each of at least one element selected from the group consisting of niobium, molybdenum, tungsten and silicon. If the amount of the element is less than the lower limit, no further improvement in the oxidation resistance of the compound can be expected, and if the amount exceeds the upper limit, no further improvements result from the addition of the element and the density of the compound is increased.

The Ti—Al system intermetallic compound preferably includes 0.5 at. % to 3 at. % each of at least one element selected from the group consisting of manganese, chromium and vanadium. If the amount of the element is less than the lower limit, no further improvement in the ductility can be expected, and if the amount exceeds the upper limit, no further improvements result from the addition of the element and the density of the compound is increased.

In another embodiment of the invention, a method of manufacturing a product of a Ti—Al intermetallic compound substantially comprising titanium and aluminum, comprises the steps of: introducing at least one halogen element selected from the group consisting of fluorine, chlorine, bromine and iodine into the Ti—Al intermetallic compound; forming the Ti—Al intermetallic compound into a desired shape to produce a product; and oxidizing the surface of the product thus formed.

Alternatively, surface treatment for introducing halogen on the surface of the product may be made.

The method of treating the surface of a Ti—Al system intermetallic compound comprises the steps of: heating the surface of the Ti—Al system intermetallic compound to between 800° C. and 1125° C. in a mixture gas including 2 ppm to 1% by volume of at least one halogen element selected from the group consisting of fluorine, chlorine, bromine and iodine and including 0.1% by volume or more of oxygen; and thus forming a dense aluminum oxide film on the surface of the Ti—Al system intermetallic compound.

The reasons for the limitations on the numerical values are now explained.

(1) The amount of the halogen elements is limited as aforementioned, because if the amount is less than the lower limit, an ununiformly thick aluminum oxide film is formed, and if the amount exceeds the upper limit, an imperfect aluminum oxide film is formed. In both cases the oxidation resistance is insufficient.

(2) The amount of oxygen is limited as aforementioned, because if the amount is less than the lower limit, only a thin aluminum oxide film is formed and the oxidation resistance is insufficient.

(3) The treatment temperature is limited as aforementioned, because if the temperature is lower than the lower limit, only a thin aluminum oxide film is formed. If the temperature exceeds the upper limit, the generation of the alpha phase, i.e., alpha solid solution of titanium alloy containing small amounts of aluminum, which tends to be easily oxidized, results in an ununiformly thick aluminum oxide film. In both cases the oxidation resistance is insufficient.

The aforementioned mixture of gas can include nitrogen gas or other inactive gas. Unavoidable foreign particles can be contained in the gas mixture. The inactive gas can be argon gas or other. The gas mixture can contain multiple kinds of inactive gases.

The method of treating the surface of a Ti—Al system intermetallic compound can comprise the steps of: placing a halogen compound including at least one halogen element selected from the group consisting of fluorine, chlorine, bromine and iodine on the surface of the part, providing the oxidation resistance of the Ti—Al system intermetallic compound, the amount of the halogen compound being between 0.002 mol/m$^2$ and 2 mol/m$^2$; heating the Ti—Al system intermetallic compound to between 800° C. to 1125° C. for 0.2 hour at least; and thus forming a dense aluminum oxide film on the surface of the Ti—Al system intermetallic compound.

The Ti—Al system intermetallic compound is preferably heated in the air.

The halogen compound placed on the surface of the part, providing the oxidation resistance of the Ti—Al system intermetallic compound, is a solid. The intermetallic compound with the solid halogen compound disposed thereon is heated to the melting point of the halogen compound or a higher temperature. Alternatively, the halogen compound can be liquid.

The halogen amount and the treatment temperature are limited as aforementioned, because if these conditions are out of the limited range, only an insufficient oxidation resistance results. If the time period for the surface treatment is less than the lower limit, only a thin aluminum oxide film is formed and an insufficient oxidation resistance results. Further, if the heating process is lengthened over ten hours, no further effect of the formed aluminum oxide film can be expected. Therefore, the heating process need not to be continued longer than ten hours.

In the invention, by adding a halogen including halide, the oxidation resistance of the Ti—Al system intermetallic compound is remarkably enhanced.

To provide a Ti—Al system intermetallic compound having wear resistance, in a further embodiment of the invention, a product of the Ti—Al system intermetallic compound comprises 25 at. % to 75 at. % of aluminum, 0.004 at. % to 1 at. % of at least one halogen element selected from the group consisting of fluorine, chlorine, bromine and iodine and the remainder of titanium and unavoidable impurities. A dense aluminum oxide film having a thickness between 1 μm and 50 μm is formed on the surface of the part, providing the wear resistance of the product.

The product of the Ti—Al system intermetallic compound comprises 0.05 at. % to 10 at. % of manganese.

Additionally, to provide a Ti—Al system intermetallic compound having a wear resistance, a method of manufacturing a product of the Ti—Al system intermetallic compound comprising 25 at. % to 75 at. % of aluminum, 0.004 at. % to 1 at. % of at least one halogen element selected from the group consisting of fluorine, chlorine, bromine and iodine and the reminder of titanium and unavoidable impurities, comprises the steps of oxidizing a Ti—Al system intermetallic compound in the temperature range from 800° C. to 1125° C. in an oxidizing atmosphere; and forming a dense aluminum oxide film on the surface of the intermetallic compound.

In the method of manufacturing a product of Ti—Al system intermetallic compound, the product further includes 0.05 at. %. to 10 at. % of manganese.

The reasons for the aforementioned limitations of the numerical values are now explained.

(1) The Amount of Aluminum

If the amount is less than the lower limitation, no continuous aluminum oxide film is formed and an insufficient wear resistance results, and if the amount exceeds the upper limitation, no further wear resistance can be expected.

(2) The Amount of Halogen

If the amount is less than the lower limitation, an aluminum oxide film having good adhesion to the base fails to be formed and the wear resistance is lowered, and if the amount exceeds the upper limitation, the ductility of the base material is lowered.

(3) The Thickness of an Aluminum Oxide Film

If the thickness is less than the lower limitation, the film is too thin to provide a sufficient wear resistance; and if the thickness exceeds the upper limitation, the film is so thick that it easily cracks and provides a low wear resistance.

(4) The Amount of Manganese

If the amount is less than the lower limitation, the ductility is not enhanced, and if the amount exceeds the upper limitation, no further improvement can be expected.

(5) Thermal Treatment (Oxidizing) Temperature

If the temperature is lower than the lower limitation, only a thin aluminum oxide film is formed and the wear resistance is insufficient, and if the temperature exceeds the upper limitation, a too thick aluminum oxide film is formed, easily cracks and provides a low wear resistance.

The time period for oxidizing treatment preferably ranges from five minutes to 24 hours. If the time period is shorter than the lower limitation, only a thin aluminum oxide film is formed and provides an insufficient wear resistance, and if it exceeds the upper limitation, no further improvement is expected and productivity is decreased in vain.

DETAILED DESCRIPTION OF THE PREFERRED EMBODIMENTS

First Embodiment

Sponge titanium powder was mixed with at least one of aluminum powder; aluminum and manganese alloy powder; aluminum and chromium alloy powder; aluminum and niobium alloy powder; aluminum and molybdenum alloy powder; and aluminum and silicon alloy powder. The sponge titanium powder has a particle size of 149 μm or less and is prepared by a sodium reduction process. The intermetallic compound included chlorine in the form of sodium chloride. Sodium chloride was unavoidably introduced as residual impurities, while titanium tetrachloride was reduced using sodium to form sponge titanium. The aluminum powder is prepared by an air atomizing process. Each powder to be mixed with the sponge titanium powder has a particle size of 149 μm or less. These kinds of powder were mixed in a proportion such that the sample Nos. 1–11 shown in Table 1 were obtained as the final compositions. The mixed powder was introduced in an aluminum container. Subsequently, while being heated, the container was exhausted through a vacuum. After this degassing process, the container including the mixed powder was hot-extruded at 430° C. and at the extrusion ratio of 91. The extruded material was then cut out of the aluminum container. A reacting synthesis process was then started from the extruded material: the extruded material was processed by a hot isostatic pressing process at 560° C. to form a Ti—Al system intermetallic compound. Subsequently, the intermetallic compound was homogenized by further continued hot isostatic pressing process performed for ten hours at 1300° C. This homogenization was carried out in an atmosphere of argon gas and under a pressure of 180 MPa.

Tension-test pieces were prepared from the sample Nos. 1–11 obtained as aforementioned. The test pieces have a parallel-part diameter of 5 mm and a gauge length of 15 mm. Tension test was carried out on the test pieces at room temperature, in which the rate of strain was $10^{-3}$/second. The elongation of the test pieces were also measured.

Further test pieces having a size of 7 mm×7 mm×15 mm were cut from the samples of the Ti—Al system intermetallic compound. The surface of the test pieces was polished with #800 emery paper, and a high temperature oxidation test was carried out for 24 hours at 975° C. in the atmosphere. The test results are shown in Table 1.

As shown in Table 1, the sample Nos. 1–11 embodying the invention have an oxidation increase of 15 g/m$^2$ or less. These samples have such a small oxidation increase and are superior in their oxidation resistance.

Especially, the sample Nos. 5–7, including niobium, molybdenum and silicon in the range between 0.5 at. % and 3 at. %, respectively, have an oxidation increase of 5 to 9 g/m$^2$ and thus have superior oxidation resistance.

TABLE 1

| SAMPLE NO. | CHEMICAL COMPOSITION (at. %) (remainder at. % correspond to the amount of Ti | | | | | | | TENSILE STRENGTH (MPa) | ELONGATION (%) | OXIDATION INCREASE (g/m$^2$) | OXIDE FILM THICKNESS (μm) |
|---|---|---|---|---|---|---|---|---|---|---|---|
| | Cl | Al | Mn | Cr | Nb | Mo | Si | | | | |
| 1 | 0.10 | 48 | — | — | — | — | — | 566 | 0.5 | 10 | 3 |
| 2 | 0.85 | 48 | — | — | — | — | — | 572 | 0.7 | 7 | 2 |
| 3 | 0.05 | 46 | 2 | — | — | — | — | 585 | 1.3 | 13 | 4 |
| 4 | 0.10 | 46 | — | 2 | — | — | — | 589 | 1.2 | 15 | 5 |
| 5 | 0.08 | 41 | — | — | 3 | — | — | 579 | 1.7 | 5 | 2 |
| 6 | 0.07 | 46 | — | — | — | 2 | — | 572 | 0.7 | 8 | 3 |
| 7 | 0.04 | 46 | 2 | — | — | — | 0.5 | 536 | 0.6 | 9 | 4 |
| 8 | 0.03 | 48 | 0.4 | — | — | — | — | 479 | 0.9 | 14 | 5 |
| 9 | 0.04 | 48 | 3.2 | 1.2 | — | — | — | 595 | 1.5 | 15 | 5 |
| 10 | 0.05 | 44 | — | 1.2 | 3.4 | — | — | 600 | 1.9 | 10 | 3 |
| 11 | 0.05 | 48 | — | — | — | — | 0.3 | 472 | 0.3 | 10 | 3 |

Second Embodiment

Titanium powder having a particle size of 149 μm or less prepared by a hydrogenation-dehydrogenation process was mixed with one of the aluminum powders, prepared by a helium gas atomizing process; aluminum and vanadium alloy powder; aluminum and silicon alloy powder; tungsten powder; and aluminum and manganese alloy powder; each having a particle size of 149 μm or less, in a proportion such that the sample Nos. 12–17 shown in Table 2 were obtained as the final chemical compositions.

The intermetallic compound included chlorine in the form of magnesium chloride. Magnesium chloride was unavoidably introduced as residual impurities while titanium powder was produced. The sample No. 17 in Table 2 was obtained by adding zinc fluoride having an average particle size of 0.3 μm as a halide at the first stage of the process. Subsequently, the mixed powder was introduced in an aluminum container. While being heated, the container was exhausted through a vacuum. After this degassing process, the aluminum container containing the mixed powder was hot-extruded at 400° C. and at the extrusion ratio of 63. The extruded material was then cut out of the container. A reacting synthesis process was then started from the extruded material: the extruded material was processed by a hot isostatic pressing process at 560° C. to form a Ti—Al system intermetallic compound. Subsequently, the intermetallic compound was homogenized by further continued hot isostatic pressing process performed for twelve hours at 1250° C. This homogenization was carried out in an atmosphere of argon gas and under a pressure of 160 MPa.

In the same way as in the first embodiment, the tension test pieces were prepared, the tension test was conducted, and the elongation of the test pieces was also measured. Further, the high temperature oxidation test was carried out. The test results are shown in Table 2.

As clearly shown in Table 2, the sample Nos. 12–17 have a remarkably small oxidation increase of 25 g/m$^2$ or less and are preferably superior in oxidation resistance.

Especially, the sample Nos. 14–16, including silicon or tungsten in the range between 0.5 at. % and 1.5 at. %, have a remarkably small oxidation increase of 7 g/m$^2$ and thus have superior oxidation resistance.

TABLE 2

| SAMPLE NO. | CHEMICAL COMPOSITION (at. %) (remainder at. % correspond to the amount of Ti) F | Cl | Al | Mn | V | Si | W | TENSILE STRENGTH (MPa) | ELONGATION (%) | OXIDATION INCREASE (g/m$^2$) | OXIDE FILM THICKNESS (μm) |
|---|---|---|---|---|---|---|---|---|---|---|---|
| 12 | — | 0.006 | 48 | — | — | — | — | 572 | 0.7 | 25 | 35 |
| 13 | — | 0.01 | 46 | — | 2 | — | — | 595 | 1.0 | 21 | 24 |
| 14 | — | 0.03 | 47 | — | — | 0.5 | — | 559 | 0.6 | 7 | 3 |
| 15 | — | 0.01 | 47 | — | — | — | 0.5 | 548 | 0.5 | 7 | 3 |
| 16 | — | 0.01 | 47 | — | — | — | 1.5 | 568 | 0.5 | 7 | 3 |
| 17 | 0.05 | 0.003 | 48 | 2 | — | — | — | 498 | 0.5 | 12 | 4 |

Third Embodiment

Titanium powder having a particle size of 149 μm or less prepared by a plasma rotating electrode process was mixed with at least one of the aluminum powders prepared by a helium gas atomizing process; aluminum and manganese alloy powder; aluminum and silicon alloy powder; and aluminum, niobium and silicon alloy powder, each having a particle size of 149 μm or less: and was further mixed with a halide powder having a particle size of 2 μm, in a proportion such that the sample Nos. 18–21 shown in Table 3 were obtained as the final chemical compositions.

At this stage, as the halide powder, zinc fluoride was used to form sample No. 18, sodium chloride was used to form sample No. 19, silver bromide was used to form sample No. 20, and silver iodide was used to form sample No. 21.

Subsequently, the mixed powder was introduced in an aluminum container. While being heated, the container was exhausted through a vacuum. After this degassing process, the aluminum container containing the mixed powder was hot-extruded at 400° C. and at the extrusion ratio of 63. The extruded material was cut out of the container. A reacting synthesis process was then started from the extruded material: the extruded material was processed by a hot isostatic pressing process at 560° C. to form a Ti—Al system intermetallic compound. Subsequently, the intermetallic compound was homogenized by further continued hot isostatic pressing process performed for two hours at 1300° C. This homogenization was carried out in an atmosphere of argon gas and under a pressure of 150 MPa.

In the same way as in the first embodiment, the tension test pieces were prepared, the tension test was conducted, and the elongation of the test pieces was also measured. Further, the high temperature oxidation test was carried out. The test results are shown in Table 3.

As clearly shown in Table 3, the sample Nos. 18–21 have a small oxidation increase of 25 g/m$^2$ or less and are preferably superior in oxidation resistance.

TABLE 3

| SAMPLE NO. | CHEMICAL COMPOSITION (at. %) (remainder at. % correspond to the amount of Ti) F | Cl | Br | I | Al | Mn | Nb | Si | TENSILE STRENGTH (MPa) | ELONGATION (%) | OXIDATION INCREASE (g/m$^2$) | OXIDE FILM THICKNESS (μm) |
|---|---|---|---|---|---|---|---|---|---|---|---|---|
| 18 | 0.1 | — | — | — | 48 | — | — | — | 489 | 0.3 | 18 | 12 |
| 19 | — | 0.05 | — | — | 46 | 2 | — | — | 505 | 1.0 | 14 | 4 |
| 20 | — | — | 0.04 | — | 47 | — | — | 0.5 | 512 | 0.4 | 20 | 21 |
| 21 | — | — | — | 0.01 | 41 | — | 3 | 0.5 | 531 | 0.9 | 25 | 40 |

FIRST REFERENCE EXAMPLE

In the same way as the second embodiment, the sample No. 22 of the Ti—Al system intermetallic compound containing a small amount of chlorine was prepared.

In the same way as the second embodiment, the tension test piece was cut from the sample No. 22, the tension test was carried out and the elongation was also measured. Further, the high temperature oxidation test was conducted. The test results are shown in Table 4, which also shows second and third reference examples described later.

As clearly shown in Table 4, the sample No. 22 has a remarkably large oxidation increase of 286 g/m$^2$ and is undesirably inferior in oxidation resistance.

SECOND REFERENCE EXAMPLE

In the same way as the third embodiment, sample No. 23 containing a relatively small amount of chlorine and sample No. 24 containing a large amount of halogen element were prepared.

In the same way as the third embodiment, the tension test pieces were prepared from the samples, the tension tests were carried out and the elongations were also measured. Further, the high temperature oxidation test was conducted. The test results are shown in Table 4.

As clearly shown in Table 4, the sample No. 23 has a remarkably large oxidation increase of 268 g/m$^2$ and is undesirably inferior in oxidation resistance. The sample No. 24 unfavorably has is a small elongation of 0% and inferior in ductility.

THIRD REFERENCE EXAMPLE

By an ingot process, titanium, aluminum and manganese were blended in such a composition that 51 at. % of titanium, 47.3 at. % of aluminum and 1.7 at. % of manganese were included. Thus obtained metal was rolled over three times and dissolved by a plasma arc dissolution.

Specifically, one output of an arc power source is connected to a metal ingot to be dissolved, and the other output is connected to an electrode disposed at a specified distance from the ingot. When a specified voltage is applied from the arc source, an arc is generated between the ingot and the electrode. By introducing argon, hydrogen or nitrogen gas into the region of arc generation, the gas is made into a plasma jet for dissolving the ingot.

If the ingot is dissolved only once, the content of the ingot is segregated. Therefore, the dissolving is discontinued, the ingot is rolled over and the dissolving is resumed. This process was repeated three times in this example and other embodiments.

Thus, sample No. 25 of ingot containing little chlorine was obtained.

In the same way as the third embodiment, the tension test piece was prepared from the sample, the tension test was carried out and the elongation was also measured. Further, the high temperature oxidation test was conducted. The test results are shown in Table 4.

As clearly shown in Table 4, the sample No. 25 has a remarkably large oxidation increase of 342 g/m$^2$ and is undesirably inferior in oxidation resistance.

TABLE 4

| SAMPLE NO. | CHEMICAL COMPOSITION (at. %) (remainder at. % correspond to the amount of Ti) Cl | Al | Mn | TENSILE STRENGTH (MPa) | ELONGATION (%) | OXIDATION INCREASE (g/m$^2$) | OXIDE FILM THICKNESS (μm) |
|---|---|---|---|---|---|---|---|
| 22 | 0.003 | 46 | 2 | 576 | 1.3 | 286 | 160* |
| 23 | <0.001 | 48 | — | 554 | 0.7 | 268 | 140* |
| 24 | 1.1 | 47 | — | 441 | 0 | 20 | 6 |
| 25 | <0.001 | 46 | 2 | 570 | 1.5 | 342 | 241* |

NOTE: *THESE OXIDE FILMS ARE FILMS OF BOTH ALUMINUM OXIDE AND TITANIUM OXIDE, NOT OF ALUMINUM OXIDE ONLY.

As aforementioned, the Ti—Al system intermetallic compounds embodying the invention include 0.004 at. % to 1.0 at. % of a halogen element. Thus, the oxidation resistance of the compounds is enhanced. The compounds are superior to ordinary heat-resistant steels in oxidation resistance, have almost the same oxidation resistance as that of heat-resistance alloys having a base of nickel, and are appropriately light-weight, heat-resistant materials. If the aforementioned tests of the embodiments are applied to a heat-resistant SUH35 steel and Nimonic® alloy, the steel and the alloy indicate the oxidation increase of 45 g/m$^2$ and 15 g/m$^2$, respectively.

Fourth Embodiment

First, titanium and aluminum were blended, such that the obtained metal was composed of 50 at. % of titanium and 50 at. % of aluminum.

The metal was rolled over three times and dissolved by a plasma arc dissolution, to form an ingot.

A test piece having a size of 7 mm×7 mm×15 mm was cut from the ingot, and the surface of the test piece was polished with #800 emery paper. The polished test piece was heated at 875° C. for twelve hours in an atmosphere containing 50 ppm of fluorine, 20% by volume of oxygen and the remainder of nitrogen. Thus, an oxidation-resistant aluminum oxide film was formed on the surface of the test piece.

This test piece was again heated at 950° C. for 24 hours in the air. The oxidation increase of the test piece after the heating process was measured. The test piece is shown in Table 5, as sample No. 26.

Fifth Embodiment

First, titanium, aluminum and manganese were blended, such that the obtained metal was composed of 51 at. % of titanium, 47.3 at. % of aluminum and 1.7 at. % of manganese.

In the same way as the fourth embodiment, an ingot was formed from the metal. A test piece having a diameter of 4 mm and a length of 15 mm was cut from the ingot, and the surface of the test piece was polished with #800 emery paper.

The polished test piece was heated at 950° C. for four hours in an atmosphere containing 200 ppm of chlorine, 20% by volume of oxygen and the remainder of nitrogen. Thus, an aluminum oxide film was formed on the surface of the test piece.

Subsequently, in the same way as the fourth embodiment, the oxidation increase of the test piece after the heating process was measured. The test piece is shown in Table 5, as sample No. 27.

Sixth Embodiment

First, titanium, aluminum and chromium were blended, such that the obtained metal was composed of 50.7 at. % of titanium, 47.8 at. % of aluminum and 1.5 at. % of chromium.

Subsequently, in the same way as the fifth embodiment, an ingot was formed from the metal, a test piece was cut from the ingot, and the surface of the test piece was polished.

The polished test piece was heated at 1000° C. for thirty minutes in an atmosphere containing 500 ppm of bromine and the remainder of oxygen. Thus, an aluminum oxide film was formed on the surface of the test piece.

Subsequently, in the same way as the fourth embodiment, the oxidation increase of the test piece after the heating process was measured. The test piece is shown in Table 5, as sample No. 28.

Seventh Embodiment

First, titanium, aluminum and vanadium were blended, such that the obtained metal was composed of 51.0 at. % of titanium, 46.7 at. % of aluminum and 2.3 at. % of vanadium.

Subsequently, in the same way as the fifth embodiment, an ingot was formed from the metal, a test piece was cut from the ingot, and the surface of the test piece was polished.

The polished test piece was heated at 750° C. for thirty hours in an atmosphere containing 8000 ppm of iodine, 100 ppm of oxygen and the remainder of nitrogen. Thus, an aluminum oxide film was formed on the surface of the test piece.

Subsequently, in the same way as the fourth embodiment, the oxidation increase of the test piece after the heating process was measured. The test piece is shown in Table 5, as sample No. 29.

Eighth Embodiment

First, titanium and aluminum were blended, such that the obtained metal was composed of 50 at. % of titanium and 50 at. % of aluminum.

Subsequently, in the same way as the fifth embodiment, an ingot was formed from the metal, a test piece was cut from the ingot, and the surface of the test piece was polished.

The polished test piece was heated at 1000° C. for one hundred minutes in an atmosphere containing 20 ppm of fluorine, 1000 ppm of chlorine, 1% by volume of oxygen and the remainder of nitrogen. Thus, an aluminum oxide film was formed on the surface of the test piece.

Subsequently, in the same way as the fourth embodiment, the oxidation increase of the test piece after the heating process was measured. The test piece is shown in Table 5, as sample No. 30.

Ninth through Eleventh Embodiments

Test pieces were prepared as sample Nos. 31–33 shown in Table 5. For the composition of the Ti—Al system intermetallic compound and the atmosphere for the surface treatment, refer to Table 5.

The other conditions were the same as those of the fourth embodiment. Thus, an aluminum oxide film was formed on the surface of the test piece.

Subsequently, in the same way as the fourth embodiment, the oxidation increase of the test piece after the heating process was measured. The test conditions and results are shown in Table 5.

FOURTH REFERENCE EXAMPLE

First, titanium and aluminum were blended, such that the obtained metal was composed of 50 at. % of titanium and 50 at. % of aluminum.

Subsequently, in the same way as the fifth embodiment, an ingot was formed from the metal, a test piece was cut from the ingot, and the surface of the test piece was polished.

The polished test piece was heated at 1000° C. for six hours in an atmosphere containing 1 ppm of fluorine and the remainder of oxygen. Thus, an aluminum oxide film was formed on the surface of the test piece.

Subsequently, in the same way as the fourth embodiment, the oxidation increase of the test piece after the heating process was measured. The test piece is shown in Table 5, as sample No. 34.

FIFTH REFERENCE EXAMPLE

First, titanium, aluminum and manganese were blended, such that the obtained metal was composed of 51 at. % of titanium, 47.3 at. % of aluminum and 1.7 at. % of manganese. Subsequently, in the same way as the fifth embodiment, an ingot was formed from the metal, a test piece was cut from the ingot, and the surface of the test piece was polished.

The polished test piece was heated at 850° C. for ten hours in an atmosphere containing 1.1% by volume of chlorine, 20% by volume of oxygen and the remainder of nitrogen. Thus, an aluminum oxide film was formed on the surface of the test piece.

Subsequently, in the same way as the fourth embodiment, the oxidation increase of the test piece after the heating process was measured. The test piece is shown in Table 5, as sample No. 35.

SIXTH REFERENCE EXAMPLE

First, titanium and aluminum were blended, such that the obtained metal was composed of 50 at. % of titanium and at. % of aluminum.

Subsequently, in the same way as the fifth embodiment, an ingot was formed from the metal, a test piece was cut from the ingot, and the surface of the test piece was polished.

The polished test piece was heated at 725° C. for two hours in an atmosphere containing 500 ppm of bromine, 5 ppm of oxygen and the remainder of nitrogen. Thus, an aluminum oxide film was formed on the surface of the test piece.

Subsequently, in the same way as the fourth embodiment, the oxidation increase of the test piece after the heating process was measured. The test piece is shown in Table 5, as sample No. 36.

SEVENTH REFERENCE EXAMPLE

First, titanium, aluminum and manganese were blended, such that the obtained metal was composed of 51 at. % of titanium, 47.3 at. % of aluminum and 1.7 at. % of manganese.

Subsequently, in the same way as the fifth embodiment, an ingot was formed from the metal, a test piece was cut from the ingot, and the surface of the test piece was polished.

The polished test piece was heated at 900° C. for twenty hours in an atmosphere containing 20% by volume of oxygen and the remainder of nitrogen. Thus, an aluminum oxide film was formed on the surface of the test piece.

Subsequently, in the same way as the fourth embodiment, the oxidation increase of the test piece after the heating process was measured. The test piece is shown in Table 5, as sample No. 37.

TABLE 5

| SAMPLE NO. | CHEMICAL COMPOSITION OF Ti-Al SYSTEM INTERMETALLIC COMPOUND [AT. %] (Remainder at. % corresponds to the amount of Ti.) | ATMOSPHERE FOR SURFACE TREATMENT [% BY VOLUME] | | | | | | OXIDATION INCREASE [g/m²] | OXIDE FILM THICKNESS [μm] |
|---|---|---|---|---|---|---|---|---|---|
| | | F | Cl | Br | I | O | REMAINDER | | |
| 26 | Ti-50Al | 0.005 | — | — | — | 20 | $N_2$ | 8 | 4 |
| 27 | Ti-47.3Al-1.7Mn | — | 0.02 | — | — | 20 | $N_2$ | 5 | 3 |
| 28 | Ti-47.8Al-1.5Cr | — | — | 0.05 | — | REMAINDER | — | 6 | 3 |
| 29 | Ti-46.7Al-2.3V | — | — | — | 0.8 | 0.01 | $N_2$ | 10 | 4 |
| 30 | Ti-50Al | 0.002 | 0.1 | — | — | 1 | $N_2$ | 3 | 2 |
| 31 | Ti-50Al | — | 0.5 | — | — | 20 | Ar | 8 | 4 |
| 32 | Ti-46.8Al-2.1Mn | — | — | 0.04 | — | 0.1 | Ar | 10 | 5 |
| 33 | Ti-47.8Al-1.5Cr | 0.01 | — | — | — | 0.1 | Ar | 10 | 4 |
| 34 | Ti-50Al | 0.0001 | — | — | — | REMAINDER | — | 124 | 135* |
| 35 | Ti-47.3Al-1.7Mn | — | 1.1 | — | — | 20 | $N_2$ | 78 | 97* |
| 36 | Ti-50Al | — | — | 0.05 | — | 0.0005 | $N_2$ | 59 | 36* |
| 37 | Ti-47.3Al-1.7Mn | — | — | — | — | 20 | $N_2$ | 240 | 155* |

NOTE:* These films include titanium oxide in addition to aluminum oxide.

As shown in Table 5, the sample Nos. 26–33 embodying the invention have a relatively small oxidation increase of 10 g/m² or less and are superior in the oxidation resistance.

However, the sample Nos. 34–37 of the reference examples have a large oxidation increase of 59 g/m² and are unfavorably inferior in their oxidation resistance.

Twelfth Embodiment

First, titanium and aluminum were blended, such that the obtained metal was composed of 50 at. % of titanium and 50 at. % of aluminum.

The metal was rolled over three times and dissolved by a plasma arc dissolution, to form an ingot.

The test piece having a size of 7 mm×7 mm×15 mm was cut from the ingot, and the surface of the test piece was polished with #800 emery paper.

Subsequently, the polished test piece was introduced into a crucible, such that at least three corners of the bottom of the piece were supported by the inner face of the crucible. After 140 mg of a solid manganese chloride was laid on the upper surface of the piece, the crucible was heated at 900° C., the temperature higher than the melting point of manganese chloride, for two hours in the air. Thus, manganese chloride was applied onto the entire surfaces of the piece.

As a result, manganese chloride was melted and applied onto the surface of the test piece. The amount of the halogen element disposed on the surface of the test piece was 1.208 mol/m², which value is obtained by dividing the mol number of 140 mg of the melted manganese chloride by the entire surface area of the test piece.

After the aforementioned heating process, the test piece was cut, and its cross section was polished and observed. It was confirmed that an oxidation-resistant aluminum oxide film having the thickness of about 2 μm was formed on the surface of the test piece.

Subsequently, the test piece was heated at 950° C. for 24 hours in the air, and the oxidation increase after the heating process was measured. Table 6 shows the test conditions and results of the test piece as sample No. 38.

The amount of the halogen element in the test piece can be obtained in the following equation (1):

$$C=(W/(Mo\cdot A))\cdot M_H/Mo \quad (1),$$

in which

C denotes the halogen amount [mol/m²] per unit area;

W denotes the addition amount [g] of a halogen compound;

A denotes the surface area [m²] of a test piece;

Mo denotes the molecular weight [g] of the halogen compound;

and $M_H$ denotes the molecular weight [g] of the halogen element in the halogen compound.

Thirteenth Embodiment

First, titanium, aluminum and manganese were blended, such that the obtained metal was composed of 51 at. % of titanium, 47.3 at. % of aluminum and 1.7 at. % of manganese.

In the same way as the twelfth embodiment, an ingot was formed, a test piece was cut out of the ingot, and the surface of the test piece was polished.

Subsequently, 14.6 mg of a solid zinc fluoride was laid on the upper surface of the polished test piece, and was then heated at 1000° C. for thirty minutes in the air. Thus, an oxidation-resistant aluminum oxide film was formed on the surface of the test piece.

Subsequently, in the same way as the twelfth embodiment, the oxidation increase after the heating process was measured. Table 6 shows the test conditions and results of the test piece as sample No. 39.

Fourteenth Embodiment

First, titanium, aluminum and manganese were blended, such that the obtained metal was composed of 50.7 at. % of titanium, 47.9 at. % of aluminum and 1.4 at. % of manganese.

In the same way as the twelfth embodiment, an ingot was formed, a test piece was cut out of the ingot, and the surface of the test piece was polished.

Subsequently, 2.29 mg of a solid silver bromide was laid on the polished test piece, and was then heated at 725° C. for five hours in the air. Thus, an oxidation-resistant aluminum oxide film was formed on the surface of the test piece.

Subsequently, in the same way as the twelfth embodiment, the oxidation increase after the heating process was measured. Table 6 shows the test conditions and results of the test piece as sample No. 40.

EIGHTH REFERENCE EXAMPLE

First, titanium and aluminum were blended, such that the obtained metal was composed of 50 at. % of titanium and 50 at. % of aluminum.

In the same way as the twelfth embodiment, an ingot was formed, a test piece was cut out of the ingot, and the surface of the test piece was polished.

Subsequently, 0.05 mg of a sodium chloride was laid on the upper surface of the polished test piece, and was then heated at 900° C. for two hours in the air. Thus, an oxidation-resistant aluminum oxide film was formed on the surface of the test piece.

Subsequently, in the same way as the twelfth embodiment, the oxidation increase after the heating process was measured. Table 8 shows the test conditions and results of the test piece as sample No. 41.

NINTH REFERENCE EXAMPLE

In the same way as the eighth reference example, a test piece composed of 50 at. % of titanium and 50 at. % of aluminum was prepared.

Subsequently, 244 mg of a solid potassium chloride was laid on the upper surface of the polished test piece, and was then heated at 1000° C. for thirty minutes in the air. Thus, an oxidation-resistant aluminum oxide film was formed on the surface of the test piece.

Subsequently, in the same way as the twelfth embodiment, the oxidation increase after the heating process was measured. Table 6 shows the test conditions and results of the test piece as sample No. 42.

TENTH REFERENCE EXAMPLE

In the same way as the eighth reference example, a test piece composed of 50 at. % of titanium and 50 at. % of aluminum was prepared.

Subsequently, 22.5 mg of a solid silver iodide was laid on the upper surface of the polished test piece, and was then heated at 675° C. for three hours in the air. Thus, an oxidation-resistant aluminum oxide film was formed on the surface of the test piece.

Subsequently, in the same way as the twelfth embodiment, the oxidation increase after the heating process was measured. Table 6 shows the test conditions and results of the test piece as sample No. 43.

ELEVENTH REFERENCE EXAMPLE

In the same way as the twelfth embodiment, a test piece composed of 51 at. % of titanium, 47.3 at. % of aluminum and 1.7 at. % of manganese was prepared.

Subsequently, 160 mg of a solid zinc fluoride was laid on the upper surface of the polished test piece, and was then heated at 1150° C. for two hours in the air. Thus, an oxidation-resistant aluminum oxide film was formed on the surface of the test piece.

Subsequently, in the same way as the twelfth embodiment, the oxidation increase after the heating process was measured. Table 6 shows the test conditions and results of the test piece as sample No. 44.

TWELFTH REFERENCE EXAMPLE

In the same way as the eighth reference example, a test piece composed of 50 at. % of titanium and 50 at. % of aluminum was prepared and polished, with no surface treatment by means of a halogen compound applied thereon.

Subsequently, in the same way as the twelfth embodiment, the oxidation increase after the heating process was measured. Table 6 shows the test conditions and results of the test piece as sample No. 45.

THIRTEENTH REFERENCE EXAMPLE

In the same way as the eleventh example, a test piece composed of 51 at. % of titanium, 47.3 at. % of aluminum and 1.7 at. % of manganese was prepared and polished, without treating the surface thereof using a halogen compound.

Subsequently, in the same way as the twelfth embodiment, the oxidation increase after the heating process was measured. Table 6 shows the test conditions and results of the test piece as sample No. 46.

TABLE 6

| SAMPLE NO. | CHEMICAL COMPOSITION OF Ti-Al SYSTEM INTERMETALLIC COMPOUND [AT. %] (Remainder at. % corresponds to the amount of Ti.) | COMPOUND KIND | HALOGEN AMOUNT [mol/m$^2$] | SURFACE TREATMENT CONDITIONS TEMPERATURE [°C.] | TIME [h] | OXIDATION INCREASE [g/m$^2$] |
|---|---|---|---|---|---|---|
| EMBODIMENTS | | | | | | |
| 38 | Ti-50Al | $MnCl_2$ | 1.2 | 900 | 2 | 5 |
| 39 | Ti-47.3Al-1.7Mn | $ZnF_2$ | 0.1 | 1000 | 0.5 | 6 |
| 40 | Ti-47.9Al-1.4Mn | AgBr | 0.01 | 725 | 5 | 7 |
| REFERENCES | | | | | | |
| 41 | Ti-50Al | NaCl | 0.001 | 900 | 2 | 135 |
| 42 | Ti-50Al | KCl | 3 | 1000 | 0.5 | 98 |
| 43 | Ti-50Al | AgI | 0.1 | 675 | 3 | 126 |
| 44 | Ti-47.3Al-1.7Mn | $ZnF_2$ | 1.1 | 1150 | 2 | 340 |
| 45 | Ti-50Al | | NIL | | | 148 |
| 46 | Ti-47.3Al-1.7Mn | | NIL | | | 244 |

As shown in Table 8, the sample Nos. 38–40 embodying the invention have an oxidation increase of 7 g/m$^2$ or less and are favorably superior in oxidation resistance.

On the other hand, the sample Nos. 41–48 of the reference examples have an oxidation increase of 98 g/m$^2$ or more and are unfavorably inferior in oxidation resistance.

Fifteenth Embodiment

Sponge titanium powder including sodium chloride as impurities, having a particle size of 149 μm or less and prepared by a sodium reduction process was mixed with aluminum powder or aluminum alloy powder, which was prepared by the helium atomizing process and has a particle size of 149 μm or less, in a proportion such that sample Nos. 48, 52, 53 and 63 shown in Table 7 were obtained as the final compositions. The mixed powder was introduced in an aluminum container. Subsequently, while being heated, the container was exhausted through a vacuum. After this deaeration process, the container including the mixed powder was hot-extruded at 430° C. and at the extrusion ratio of 45. The extruded material was then cut out of the aluminum container. Reacting synthesis process was then started from the extruded material: the extruded material was processed by a hot isostatic pressing process at 560° C. to form a Ti—Al system intermetallic compound. Subsequently, the intermetallic compound was homogenized by further continued hot isostatic pressing process performed for ten hours at 1300° C. This homogenization was carried out in an atmosphere of argon gas and under a pressure of 180 MPa. Subsequently, an oxidizing treatment was performed on the surface of the intermetallic compound in the atmosphere under the conditions given in Table 7, so that an aluminum oxide film was formed on the surface of the intermetallic compound.

Sixteenth Embodiment

The titanium powder which was prepared by a plasma rotating electrode process and has a particle size of 297 μm or less was mixed with aluminum powder or aluminum alloy powder which was prepared by an argon gas atomizing process and has a particle size of 149 μm or less, and was mixed further with zinc fluoride powder having a particle size of 149 μm or less, in a proportion such that the sample Nos. 47, 50, 51 and 62 shown in Table 7 were obtained as the final chemical compositions.

Subsequently, the mixed powder was introduced in an aluminum container. While being heated, the container was exhausted through a vacuum. After this deaeration process, the aluminum container containing the mixed powder was hot-extruded at 400° C. and at the extrusion ratio of 45. The extruded material was then cut out of the container. Reacting synthesis process was then started from the extruded material: the extruded material was processed by a hot isostatic pressing process at 560° C. to form a Ti—Al system intermetallic compound. Subsequently, the intermetallic compound was homogenized by further continued hot isostatic pressing process performed for ten hours at 1200° C. This homogenization was carried out in an atmosphere of argon gas and under a pressure of 150 MPa. Subsequently, an oxidizing treatment was performed on the surface of intermetallic compound in the atmosphere under the conditions given in Table 7, so that an aluminum oxide film was formed on the surface of the intermetallic compound.

Seventeenth Embodiment

A powder having a particle size of 74 μm, or less, and being prepared by hydrogenating-dehydrogenating the sponge titanium prepared by Kroll's process, was mixed with aluminum powder or aluminum alloy powder, which was prepared by a helium atomizing process and has a particle size of 149 μm or less, and was mixed further with silver bromide powder having a particle size of 25 μm or less, in a proportion such that sample Nos. 49, 54 and 55 shown in Table 7 was obtained as the final composition. The mixed powder was then introduced in an aluminum container. Subsequently, while being heated, the container was exhausted through a vacuum. After this deaeration process, the container including the mixed powder was hot-extruded at 380° C. and at the extrusion ratio of 45. The extruded material was then cut out of the aluminum container. A reacting synthesis process was then started from the extruded material: the extruded material was processed by a hot isostatic pressing process at 560° C. to form a Ti—Al system intermetallic compound. Subsequently, the intermetallic compound was homogenized by further continued hot isostatic pressing process performed for ten hours at 1200° C. This homogenization was carried out in an atmosphere of argon gas and under a pressure of 150 MPa. Subsequently, an oxidizing treatment was performed on the surface of intermetallic compound in the atmosphere under the conditions given in Table 7, so that an aluminum oxide film was formed on the surface of the intermetallic compound.

Eighteenth Embodiment

Titanium powder which was prepared by a plasma rotating electrode process and has a particle size of 297 μm or less was mixed with aluminum powder or aluminum alloy powder which was prepared by an argon gas atomizing process and has a particle size of 74 μm or less, and was mixed further with silver iodide powder having a particle size of 74 μm or less, in a proportion such that the sample Nos. 56, 57, 58 and 64 shown in Table 7 was obtained as the final chemical composition.

Subsequently, the mixed powder was introduced in an aluminum container. While being heated, the container was exhausted through a vacuum. After this deaeration process, the aluminum container containing the mixed powder was hot-extruded at 400° C. and at the extrusion ratio of 45. The extruded material was then cut out of the container. A reacting synthesis process was then started from the extruded material: the extruded material was processed by a hot isostatic pressing process at 560° C. to form a Ti—Al system intermetallic compound. Subsequently, the intermetallic compound was homogenized by further continued hot isostatic pressing process performed for ten hours at 1300° C. This homogenization was carried out in an atmosphere of argon gas and under a pressure of 200 MPa. Subsequently, an oxidizing treatment was performed on the surface of intermetallic compound in the atmosphere under the conditions given in Table 7, so that an aluminum oxide film was formed on the surface of the intermetallic compound.

The Nineteenth Embodiment

The following three kinds of mixture powder were prepared.

The first mixture powder was prepared by mixing sponge titanium powder, aluminum powder and zinc fluoride powder, these material powder having the particle size of 149 μm or less, in a proportion such that the sample No. 59 in Table 7 was obtained as the final chemical composition. The sponge titanium powder was prepared by the sodium reduction process, and sodium chloride as unavoidable impurities was introduced into the powder during the process. The aluminum powder was prepared by the helium atomizing process.

The second mixture powder was prepared: the powder having the particle size of 74 μm or less and being prepared by hydrogenating-dehydrogenating the sponge titanium prepared by Kroll's process was mixed with aluminum powder prepared by the helium gas atomizing process, silver bromide powder, and the silver iodide powder, in a proportion such that the sample No. 60 shown in Table 7 was obtained as the final chemical composition. The aluminum powder has the particle size of 149 μm or less; the silver bromide powder 25 μm or less; and silver iodide powder 74 μm.

The third mixture powder was prepared: the titanium powder which was prepared by the plasma rotating electrode process and has the particle size of 297 μm or less was mixed with aluminum powder which was prepared by the argon gas atomizing process and has the particle size of 74 μm or less, and was mixed further with zinc fluoride powder, silver bromide powder and silver iodide powder, in a proportion such that the sample No. 61 in Table 7 was obtained as the final chemical composition. The zinc fluoride powder has the particle size of 149 μm or less; the silver bromide powder 25 μm or less; and the silver iodide powder 74 μm or less.

The three kinds of the mixed powder were introduced in an aluminum container, respectively. Subsequently, while being heated, the container was exhausted through a vacuum. After this deaeration process, the container including the mixed powder was hot-extruded at 400° C. and at the extrusion ratio of 45. Thus extruded material was then cut out of the aluminum container. Reacting synthesis process was then started from the extruded material: the extruded material was processed by the hot isostatic pressing process at 560° C. to form a Ti—Al system intermetallic compound. Subsequently, the intermetallic compound was homogenized by further continued hot isostatic pressing process performed for ten hours at 1300° C. This homogenization was carried out in the atmosphere of argon gas and under the pressure of 200 MPa. Subsequently, the oxidizing treatment was made on the surface of the intermetallic compound in the atmosphere under the conditions given in Table 7, so that an aluminum oxide film was formed on the surface of the intermetallic compound.

REFERENCE EXAMPLES (SAMPLE NOS. 65–81)

As reference examples, the sample Nos. 65–81 shown in Table 8 were prepared: the sample Nos. 66, 69 and 75 were prepared in the same way as the aforementioned fifteenth embodiment; the sample Nos. 65, 68, 74, 80 and 81 were prepared in the same way as the sixteenth embodiment; the sample Nos. 76 and 77 were prepared in the same way as the seventeenth embodiment; the sample Nos. 67, 70, 78 and 79 were prepared in the same way as the eighteenth embodiment. The sample No. 71 was prepared in the same way as- the eighteenth embodiment but has no silver iodide added; the sample No. 72 was prepared in the same way as the sample No. 71 but has no oxidizing treatment applied; and the sample No. 73 was prepared by applying no oxidizing treatment to conventional carburized material.

The elongation and specific abrasion loss of the samples representing the aforementioned embodiments and references examples were measured.

The tensile test pieces, their straight portions having a diameter of 5 mm and a length of 15 mm, were cut from the samples. Tensometers were disposed at 10 mm intervals on the straight portions. The test pieces were pulled at room temperature and at the rate of 1 mm/s, while a chart was prepared. Then the elongations were read from the chart.

The measurement of specific abrasion loss was made as follows: test pieces having a diameter of 5 mm and a length of 8 mm were taken from the samples. The abrasion test was carried out by using a three-point type pin-on disc abrasion tester, second pieces of carburized SCM415, and spindle oil as lube oil, under a state of a face pressure of 2 MPa, a sliding speed of 1 m/sec. and an oil temperature of 100° C. The time duration of the abrasion test was one hour, during which the first test pieces were slid against the second pieces.

The desired results of the abrasion tests are shown in Table 7. The criterion elongation for evaluation is set as 0.5% or more. The desired criterion abrasion loss of both the test piece and the second piece is set as less than 0.1, provided that the abrasion loss is 1 when these test pieces are composed of 50 at. % of titanium, 48 at. % of aluminum and 2 at. % of manganese without oxidizing treatment applied thereon.

TABLE 7

| SAMPLE NO. | COMPOSITION OF Ti-Al SYSTEM INTERMETALLIC COMPOUND [at. %] | | OXIDATION TREATMENT | | OXIDE FILM THICKNESS & ELONGATION | | SPECIFIC ABRASION LOSS | | REMARKS |
|---|---|---|---|---|---|---|---|---|---|
| | Ti,Al,Mn | HALOGEN | TEMP. °C. | TIME MIN. | μm | % | TEST PIECE | SECOND PIECE | |
| 47 | Ti-27Al | 0.05F | 850 | 5 | 22 | 0.5 | 0.02 | 0.01 | — |
| 48 | Ti-50Al | 0.1 Cl | 950 | 100 | 7 | 1.2 | 0.01 | 0.01 | — |
| 49 | Ti-72Al | 0.3 Br | 825 | 720 | 15 | 0.5 | 0.01 | 0.01 | — |
| 50 | Ti-47Al | 0.004F | 800 | 30 | 1.5 | 1.0 | 0.01 | 0.01 | RELATIVELY SMALL AMOUNT OF FLUORINE |
| 51 | Ti-47Al | 1F | 1100 | 600 | 4 | 0.5 | 0.01 | 0.01 | RELATIVELY LARGE AMOUNT OF FLUORINE |
| 52 | Ti-41Al | 0.005Cl | 850 | 1400 | 40 | 0.9 | 0.01 | 0.01 | RELATIVELY SMALL AMOUNT OF CHLORINE |
| 53 | Ti-47Al | 0.9Cl | 900 | 600 | 3 | 0.9 | 0.02 | 0.01 | RELATIVELY LARGE AMOUNT OF CHLORINE |

TABLE 7-continued

| SAMPLE NO. | COMPOSITION OF Ti-Al SYSTEM INTERMETALLIC COMPOUND [at. %] Ti,Al,Mn | HALOGEN | OXIDATION TREATMENT TEMP. °C. | TIME MIN. | OXIDE FILM THICKNESS & ELONGATION μm | % | SPECIFIC ABRASION LOSS TEST PIECE | SECOND PIECE | REMARKS |
|---|---|---|---|---|---|---|---|---|---|
| 54 | Ti-47Al | 0.006Br | 890 | 60 | 3 | 0.9 | 0.01 | 0.01 | RELATIVELY SMALL AMOUNT OF BROMINE |
| 55 | Ti-47Al | 0.9Br | 1000 | 150 | 5 | 0.7 | 0.01 | 0.01 | RELATIVELY LARGE AMOUNT OF BROMINE |
| 56 | Ti-47Al | 0.005I | 800 | 10 | 37 | 1.0 | 0.01 | 0.01 | RELATIVELY SMALL AMOUNT OF IODINE |
| 57 | Ti-47Al | 0.4I | 900 | 600 | 25 | 0.7 | 0.01 | 0.01 | APPROPRIATE AMOUNT OF IODINE |
| 58 | Ti-47Al | 0.8I | 1000 | 10 | 40 | 0.5 | 0.01 | 0.01 | RELATIVELY LARGE AMOUNT OF IODINE |
| 59 | Ti-47Al | 0.02F +0.3Cl | 900 | 1200 | 3 | 0.5 | 0.01 | 0.01 | TWO KINDS OF HALOGEN |
| 60 | Ti-47Al | 0.4Br +0.09I | 900 | 600 | 10 | 0.5 | 0.01 | 0.01 | TWO KINDS OF HALOGEN |
| 61 | Ti-47Al | 0.3F +0.02B +0.2I | 1000 | 1800 | 4 | 0.5 | 0.01 | 0.01 | THREE KINDS OF HALOGEN |
| 62 | Ti-49Al-0.1Mn | 0.005F | 980 | 30 | 3 | 0.7 | 0.01 | 0.01 | — |
| 63 | Ti-47Al-3Mn | 0.2Cl | 900 | 300 | 5 | 1.6 | 0.01 | 0.01 | — |
| 64 | Ti-41Al-9Mn | 0.8I | 850 | 1400 | 40 | 0.9 | 0.01 | 0.01 | — |

TABLE 8

| SAMPLE NO. | COMPOSITION OF Ti-Al SYSTEM INTERMETALLIC COMPOUND [at. %] Ti,Al,Mn | HALOGEN | OXIDATION TREATMENT TEMP. °C. | TIME MIN. | OXIDE FILM THICKNESS & ELONGATION μm | % | SPECIFIC ABRASION LOSS TEST PIECE | SECOND PIECE | REMARKS |
|---|---|---|---|---|---|---|---|---|---|
| 65 | Ti-24Al | 0.05F | 850 | 5 | 60 | 0.5 | 0.3 | 0.4 | SMALL AMOUNT OF ALUMINUM |
| 66 | Ti-77Al | 0.1Cl | 950 | 100 | 7 | 0.1 | 0.01 | 0.01 | LARGE AMOUNT OF ALUMINUM |
| 67 | Ti-39Al-11Mn | 0.8I | 825 | 720 | 45 | 1.1 | 0.2 | 0.2 | LARGE AMOUNT OF MANGANESE |
| 68 | Ti-50Al | 0.003F | 980 | 30 | 200 | 1.5 | 1.1 | 0.9 | SMALL AMOUNT OF FLUORINE |
| 69 | Ti-47Al-3Mn | 1.2Cl | 900 | 300 | 10 | 0.1 | 0.01 | 0.01 | LARGE AMOUNT OF FLUORINE |
| 70 | Ti-48Al-2Mn | 1.1I | 975 | 150 | 85 | 0.1 | 0.2 | 0.3 | THICK FILM |
| 71 | Ti-48Al-2Mn | — | 955 | 1000 | 210 | 1.6 | 1.3 | 1.0 | NO HALOGEN |
| 72 | Ti-48Al-2Mn | | | | | 1.6 | 1 | 1 | NO OXIDATION |
| 73 | SCM415 | | | | | — | 1.0 | 1.0 | CARBURIZED STEEL |
| 74 | Ti-47Al | 1.1F | 950 | 120 | 3 | 0.2 | 0.01 | 0.01 | LARGE AMOUNT OF FLUORINE |
| 75 | Ti-47Al | 1.001Cl | 950 | 600 | 140 | 1.5 | 0.5 | 0.2 | SMALL AMOUNT OF CHLORINE |
| 76 | Ti-47Al | 0.001Br | 875 | 100 | 130 | 1.5 | 0.3 | 1.0 | SMALL AMOUNT OF BROMINE |
| 77 | Ti-47Al | 1.1Br | 1000 | 20 | 3 | 0.1 | 0.01 | 0.01 | LARGE AMOUNT OF BROMINE |
| 78 | Ti-47Al | 0.001I | 900 | 1200 | 155 | 1.4 | 0.9 | 0.9 | SMALL AMOUNT OF IODINE |
| 79 | Ti-47Al | 1.3I | 900 | 1000 | 50 | 0.1 | 0.01 | 0.01 | LARGE AMOUNT OF IODINE |
| 80 | Ti-47Al | 0.5F | 750 | 1440 | 1 | 0.5 | 0.9 | 0.8 | LOW TREATMENT TEMPERATURE |
| 81 | Ti-47Al | 0.5F | 1150 | 20 | 240 | 0.5 | 1.4 | 1.0 | HIGH TREATMENT TEMPERATURE |

As shown in Tables 7 and 8, the sample Nos. 47–64 embodying the invention desirably attain the criterion values of elongation and specific abrasion loss. The samples of the embodiments are provided with the desired ductility of a metal member and have superior oxidation resistance. The small abrasion losses of both the test pieces and the second pieces are desirable, but it is also desirable that only the test pieces have a small abrasion loss.

On the other hand, the sample Nos. 65–81 of the reference examples have undesirable elongation and specific abrasion loss.

The sample Nos. 54 and 57 contain a large amount of aluminum and halogen and have a superior wear resistance, but have a relatively small elongation. Therefore, they are substantially undesirable as metal members.

This invention has been described above with reference to preferred embodiments as shown in the tables. Modifications and alterations may become apparent to one skilled in the art upon reading and understanding the specification. Despite the use of the embodiments for illustration purposes, the invention is intended to include all such modifications and alterations within the scope and the spirit of the appended claims.

In this spirit, in the embodiments, the solid halogen compound was laid on the surface of the Ti—Al system intermetallic compound and heated to its melting point or higher temperature. Alternatively, the solution, sol, gel, or other liquid substance containing the halogen compound, can be applied onto the surface of the Ti—Al system intermetallic compound and heated. No restrictions are made as long as a specified amount of the halogen compound is laid on the intermetallic compound before heating.

As aforementioned, since the Ti—Al system intermetallic compound contains a specified amount of the halogen element, the intermetallic compound can be provided with excellent oxidation resistance. Thus, a preferably lightweight, heat-resistant material can be obtained.

Especially, the intermetallic compound containing a specified amount of at least one selected from the group consisting of niobium, molybdenum, wolfram and silicon can have a further enhanced oxidation resistance.

The intermetallic compound containing a specified amount of at least one selected from the group consisting of manganese, chromium and vanadium can have a further enhanced elongation.

During the surface treatment of a Ti—Al system intermetallic compound, the heating process is carried out at a specified temperature in the gas mixture including a specified amount of halogen and oxygen. Alternatively, the heating process is carried out by placing a specified amount of halogen on the part requiring oxidation resistance of the Ti—Al system intermetallic compound, and heating the intermetallic compound at a specified temperature for a specified time period. Thus, a dense aluminum oxide film can be formed on the surface of the intermetallic compound. The film can hinder the titanium system oxide from growing. Thus, the oxidation resistance of the Ti—Al system intermetallic compound can be enhanced.

Consequently, as aforementioned, the Ti—Al system intermetallic compound can be easily manufactured.

Additionally, a dense aluminum oxide film having a specified thickness is formed on the surface of the intermetallic compound member. Since the intermetallic compound member is highly resistant to wear and is also lightweight, it is an appropriate sliding component for use in automobiles, for example.

In a method of manufacturing a Ti—Al system intermetallic compound member, a base consisting of aluminum, halogen and titanium is heated and retained at a specified temperature in the oxidizing atmosphere. Thus, a dense aluminum oxide film having a superior wear resistance can be easily formed on the surface of the base.

If the Ti—Al system intermetallic compound includes a specified amount of manganese, the ductility of the compound is further enhanced.

What is claimed is:

1. A Ti—Al system intermetallic compound comprising substantially titanium and aluminum, and said Ti—Al system intermetallic compound having at least a surface layer including from about 0.004 at. % to about 1.0 at. % of at least one halogen element selected from the group consisting of fluorine, chlorine, bromine and iodine.

2. A Ti—Al system intermetallic compound according to claim 1, wherein said Ti—Al 'system intermetallic compound comprises from about 25 at. % to about 75 at. % of aluminum and the remainder of said Ti—Al system intermetallic compound is titanium.

3. A Ti—Al system intermetallic compound according to claim 1, wherein said Ti—Al system intermetallic compound further comprises from about 25 at. % to about 75 at. % of aluminum, from about 0.5 at. % to about 3 at. % of at least one element selected from the group consisting of niobium, molybdenum and silicon and the remainder of said Ti—Al system intermetallic compound is titanium.

4. A Ti—Al system intermetallic compound according to claim 1, wherein said Ti—Al system intermetallic compound further comprises from about 25 at. % to about 75 at. % of aluminum, from about 0.5 at. % to about 3 at. % of at least one element selected from the group consisting of niobium, molybdenum and silicon, from about 0.5 at. % to about 3 at. % of at least one element selected from the group consisting of manganese, chromium and vanadium and the remainder of said Ti—Al system intermetallic compound is titanium.

5. A Ti—Al system intermetallic compound according to claim 1, wherein said Ti—Al system intermetallic compound is formed into a desired product.

6. A product having superior wear resistance characteristics, formed from a Ti—Al system intermetallic compound, said product comprising from about 25 at. % to about 75 at. % of aluminum, from about 0.004 at. % to about 0.010 at. % of at least one halogen element selected from the group consisting of fluorine, chlorine, bromine and iodine and the remainder of said Ti—Al system intermetallic compound is titanium and unavoidable impurities; and said product having a dense aluminum oxide film, having a thickness between 1 μm and 50 μm, formed on desired surface of the product requiring wear resistance.

7. A product according to claim 6, wherein said product further includes from about 0.05 at. % to about 10 at. % of manganese.

* * * * *